US007500738B2

(12) United States Patent
Shindo

(10) Patent No.: US 7,500,738 B2
(45) Date of Patent: Mar. 10, 2009

(54) INK CARTRIDGE

(75) Inventor: Tatsuya Shindo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 261 days.

(21) Appl. No.: 10/893,503

(22) Filed: Jul. 19, 2004

(65) Prior Publication Data

US 2005/0057623 A1 Mar. 17, 2005

(30) Foreign Application Priority Data

Sep. 11, 2003 (JP) ..... 2003-319550

(51) Int. Cl.
*B41J 2/175* (2006.01)

(52) U.S. Cl. ..... 347/86; 347/85; 347/92

(58) Field of Classification Search ..... 347/92, 347/86

See application file for complete search history.

(56) References Cited

U.S. PATENT DOCUMENTS

| | | | | |
|---|---|---|---|---|
| 5,402,159 | A | 3/1995 | Takahashi et al. | |
| 5,790,157 | A * | 8/1998 | Higuma et al. | 347/85 |
| 6,270,207 | B1 * | 8/2001 | Sasaki | 347/86 |
| 6,276,786 | B1 * | 8/2001 | Eida et al. | 347/86 |
| 2001/0024226 | A1 | 9/2001 | Sasaki | |
| 2003/0030707 | A1 | 2/2003 | Sasaki | |
| 2003/0048339 | A1 | 3/2003 | Sasaki | |

FOREIGN PATENT DOCUMENTS

| | | | |
|---|---|---|---|
| EP | 0 947 328 | A2 | 10/1999 |
| EP | 1 300 248 | A2 | 4/2003 |
| EP | 1 300 249 | A2 | 4/2003 |
| JP | A 4-341851 | | 11/1992 |
| JP | 10258519 | A * | 9/1998 |
| JP | A 10-258519 | | 9/1998 |
| JP | A 2000-71472 | | 3/2000 |

* cited by examiner

*Primary Examiner*—Luu Matthew
*Assistant Examiner*—Brian J Goldberg
(74) *Attorney, Agent, or Firm*—Oliff & Berridge, PLC

(57) ABSTRACT

An ink cartridge includes a container in which ink is accommodated, an ink supply hole which is formed in the container so as to be open in an outer surface of the container, a plurality of atmosphere communication holes which are formed in the container so as to be open in the outer surface of the container, and a strip member which is removable stuck to the outer surface of the container to seal the ink supply hole and the plurality of atmosphere communication holes. The ink supply hole is sealed by a longitudinally intermediate portion of the strip member, and at least one of the plurality of atmosphere communication holes is sealed by a portion of the strip member which extends from the longitudinally intermediate portion toward one of longitudinally opposite ends thereof while at least one of the plurality of atmosphere communication holes is sealed by a portion of the strip member which extends from the longitudinally intermediate portion toward the other of the longitudinally opposite ends.

17 Claims, 11 Drawing Sheets

INK CARTRIDGE

The present application is based on Japanese Patent Application No. 2003-319550 filed Sep. 11, 2003, the contents of which are incorporated herein by reference.

BACKGROUND OF THE INVENTION

1. Field of the Invention

The present invention relates in general to an ink cartridge used for an ink-jet recording apparatus such as an ink-jet printer.

2. Discussion of Related Art

U.S. Pat. No. 6,270,207 corresponding to JP-2000-71472A (FIGS. 1 and 4, in particular) discloses one example of an ink cartridge conventionally used for an ink-jet recording apparatus. The disclosed ink cartridge includes an ink supply hole through which ink is supplied to a printing head of the apparatus and an atmosphere communication hole through which atmosphere is introduced into the inside of the ink cartridge. The ink supply hole and the atmosphere communication hole are sealed by a seal member.

In the disclosed ink cartridge, the ink supply hole and the atmosphere communication hole are first closed by the seal member, and subsequently the pressure of the inside of the ink cartridge is reduced through a pressure reduction hole. In this state, the ink is introduced into the inside of the ink cartridge through an ink filling hole. After the inside of the ink cartridge has been filled with the ink, the pressure reduction hole and the ink filling hole are closed by respective seal members.

In using the conventional ink cartridge constructed as described above, the seal member which closes the ink supply hole and the atmosphere communication hole is first removed or peeled off from the ink cartridge, and then the ink cartridge is installed on the ink-jet recording apparatus. The printing head of the apparatus sucks the ink in the ink cartridge through the ink supply hole, and ejects the ink on a recording medium such as a sheet of paper, so that desired characters and images are recorded on the recording medium. As the ink in the ink cartridge is ejected from the printing head, the atmosphere is introduced into the ink cartridge through the atmosphere communication hole, whereby the ink can be smoothly supplied to the printing head.

For reducing an amount of oxygen dissolved in the ink, the ink cartridge is generally packed in a pressure-reduced state and the inside of the ink cartridge is also kept in a pressure-reduced state. Upon removal of the seal member from the ink cartridge, the atmosphere is sucked into the cartridge through the ink supply hole if the seal member is removed such that the ink supply hole is first exposed to the atmosphere before the atmosphere communication hole is exposed to the atmosphere. In this case, there are generated layers of air and air bubbles in the vicinity of the ink supply hole. If the ink cartridge with the layers of air and air bubbles being present in the vicinity of the ink supply hole is installed on the ink-jet recording apparatus for recording operations, the air is supplied to the printing head, deteriorating the recording quality of the printing head or disabling the printing head from ejecting the ink. To avoid this, in the conventional ink cartridge, there is given an instruction in its manual that the seal member should be removed from the cartridge such that the atmosphere communication hole is first exposed to the atmosphere before the ink supply hole is exposed. Alternatively, as disclosed in JP-10-258519A (FIG. 1, in particular), there are provided, on the seal member, a multiplicity of markings which indicate an appropriate direction of removal of the seal member.

SUMMARY OF THE INVENTION

However, the user does not necessarily read the instruction given in the manual or the user may carelessly remove the seal member, without noticing the markings provided on the seal member, in a wrong direction such that the ink supply hole is first exposed to the atmosphere before the atmosphere communication hole is exposed to the atmosphere. Accordingly, in the conventional ink cartridges described above, it is impossible to avoid, with high reliability, the deterioration in the recording quality and the disability of the printing head to eject the ink as described above.

It is therefore an object of the present invention to provide an ink cartridge which is constructed such that its atmosphere communication hole is first exposed to the atmosphere before its ink supply hole is exposed, upon removal, from the ink cartridge, of a seal member which closes those holes even if the user removes the seal member without following instructions and indications which indicate an appropriate direction of removal of the seal member, to thereby avoid problems of deterioration in the recording quality and the disability of a printing head to eject the ink.

The object indicated above may be achieved according to a principle of this invention, which provides an ink cartridge comprising a container in which ink is accommodated, an ink supply hole which is formed in the container so as to be open in an outer surface of the container, a plurality of atmosphere communication holes which are formed in the container so as to be open in the outer surface of the container, and a strip member which is removably stuck to the outer surface of the container to seal the ink supply hole and the plurality of atmosphere communication holes. The ink supply hole is sealed by a longitudinally intermediate portion of the strip member, and at least one of the plurality of atmosphere communication holes is sealed by a portion of the strip member which extends from the longitudinally intermediate portion toward one of longitudinally opposite ends thereof while at least one of the plurality of atmosphere communication holes is sealed by a portion of the strip member which extends from the longitudinally intermediate portion toward the other of the longitudinally opposite ends.

In the ink cartridge constructed according to the present invention wherein the strip member has an elongate shape, it is generally difficult to remove the strip member by holding it at its widthwise opposite ends, i.e., opposite long sides. Accordingly, the strip member is removed from the ink cartridge in general by holding it at one of its lengthwise or longitudinally opposite ends, i.e., opposite short sides. Since the portion of the strip member which seals or closes the ink supply hole is located, as seen in the longitudinal direction thereof, intermediate between the portion of the strip member which seals the at least one of the plurality of atmosphere communication holes and the portion of the strip member which seals the at least one of the plurality of atmosphere communication holes different from the above-indicated at least one atmosphere communication hole. According to this arrangement, any one of the atmosphere communication holes is first exposed to the atmosphere before the ink supply hole is exposed, either in a case where the strip member is removed by holding it at one of the longitudinally opposite ends thereof and in a case where the strip member is removed by holding it at the other longitudinally opposite end. Thus, the air is sucked into or enters the container first through the atmosphere communication hole. Therefore, the present arrangement is effective to prevent, with high reliability, various problems such as poor ink ejection which would arise from the air entering the ink supply hole before entering the atmosphere communication hole.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF THE PREFERRED EMBODIMENTS

Hereinafter, there will be described some preferred embodiments of the present invention by reference to the drawings.

Figure 1:
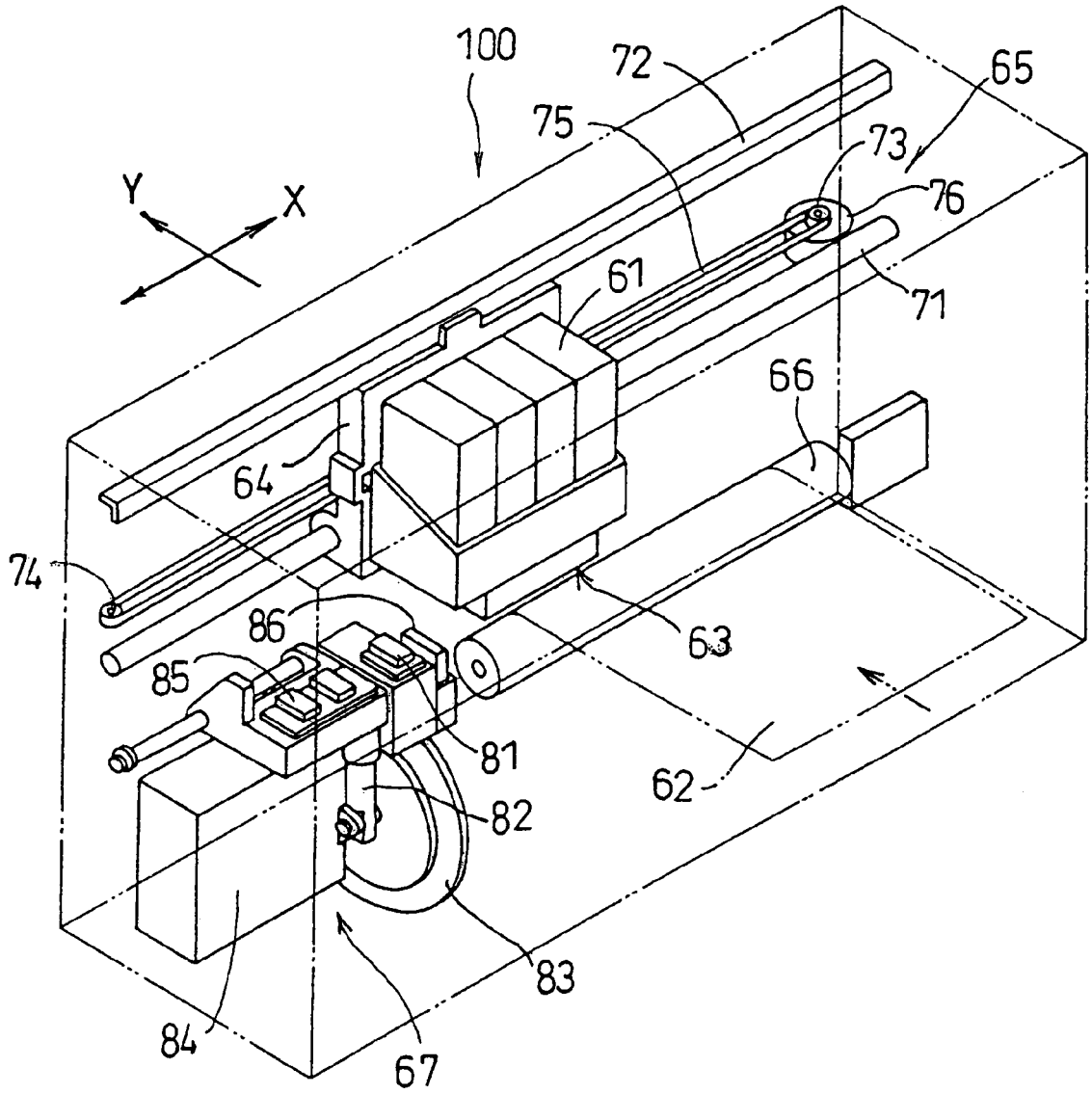
FIG. 1 is a perspective view showing an ink-jet recording apparatus to which the principle of the present invention is applied.

Referring first to the perspective view of FIG. 1, there is shown an ink-jet recording apparatus 100 equipped with an ink cartridge 61 constructed according to the first embodiment of this invention. As shown in FIG. 1, the ink-jet recording apparatus 100 includes: four ink cartridges 61 filled with respective different colors of ink, i.e., cyan, magenta, yellow and black; a printing head 63 for performing a printing operation on a recording medium in the form of a sheet of paper 62; a carriage 64 which carries the ink cartridges 61 and the printing head 63; a drive unit 65 operable to reciprocate the carriage 64 in a direction (i.e., a primary scanning direction as indicated "X" in FIG. 1) which is perpendicular to a feeding direction of the sheet of paper 62 (i.e., a secondary scanning direction as indicated "Y" in FIG. 1); a platen roller 66 extending in the direction of reciprocation of the carriage 64 and positioned in an opposed relationship with the printing head 63; and a purging device 67.

The drive unit 65 includes: a carriage shaft 71 extending in parallel with the platen roller 66 and slidably engaging a lower end portion of the carriage 64; a guide plate 72 extending in parallel with the carriage shaft 71 and slidably engaging an upper end portion of the carriage 64; two pulleys 73 and 74 disposed between the carriage shaft 71 and the guide plate 72 and located at the respective opposite ends of the carriage shaft 71; and an endless belt 75 which connects the two pulleys 73, 74 and to which the carriage 64 is fixed.

When the pulley 73 is rotated in opposite directions by an operation of a motor 76, the carriage 64 is reciprocated through the endless belt 75 fixed thereto, while being slidably supported and guided by the carriage shaft 71 and the guide plate 72.

The paper 62 is fed from a sheet supply cassette (not shown) in the above-indicated secondary scanning direction as indicated by "Y" in FIG. 1, to a location between the printing head 63 and the platen roller 66. After the printing head 63 records images on the paper 62 by droplets of ink ejected therefrom, the paper 62 is discharged.

The purging device 67 is provided on one side of the platen roller 66. When the printing head 63 is positioned at a resetting position, the purging device 67 is located such that the printing head 63 is opposed to the purging device 67. The purging device 67 includes: a purge cap 81 which is in contact with the surface of the printing head 63 in which a plurality of ink ejection nozzles 11*a* described below are open (hereinafter this surface is referred to as "nozzle surface") so as to cover the nozzles 11*a*; a suction pump 82; a cam 83; and a waste-ink reservoir 84. When the printing head 63 is at the resetting position, poor-quality ink containing air bubbles and foreign matter and remaining in the printing head 63 is sucked by the suction pump 82 that is driven by the cam 83. That is, the purging device 67 is provided to restore the printing head 63 to its normally operable states. The sucked poor-quality ink is stored in the waste-ink reservoir 84.

A wiping member 86 is disposed adjacent to one side of the purging device 67 nearer to the platen roller 66. The wiping member 86 has a spatula-like shape and wipes the nozzle surface of the printing head 63 in accordance with the movement of the carriage 64. The wiping member 86 protrudes upwardly when it is operable to wipe the nozzle surface while it is retracted downwardly when it is not operable.

The purge cap 85 is for covering the nozzles 11*a* of the printing head 63 when the printing head 63 mounted on the carriage 64 is returned to its resetting position after the printing operation, to thereby prevent evaporation of the ink.

Figure 2:
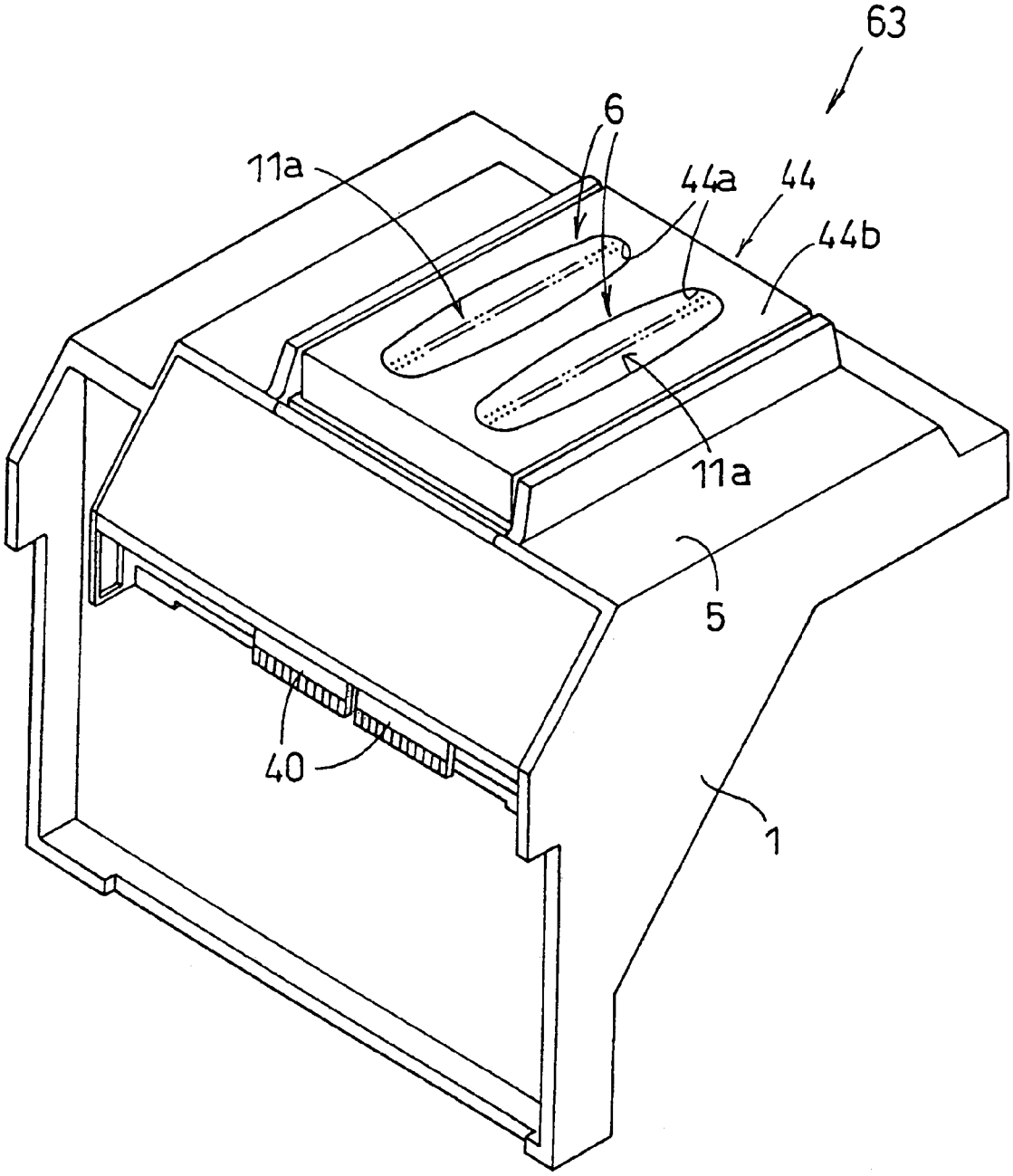
FIG. 2 is a perspective view showing a head holder as viewed from the lower surface side thereof.

As shown in FIG. 2, the printing head 63 includes two head units (printing heads) 6, 6 arranged side by side on a lower surface of a bottom plate 5 (upper surface as seen in FIG. 2) of a head holder 1 and a protective cover 44 which covers the heed units 6, 6. The protective cover 44 has a box-like shape and includes two openings 44*a*, 44*a* which are formed through the thickness of a bottom plate 44*b* of the cover 44, so that the rows of nozzles 11*a* of the respective head units 6, 6 are exposed through the respective openings 44*a*, 44*a*. The protective cover 44 is fixed to the surfaces of the head units 6, 6 and the head holder 1.

The head holder 1 is formed by injection molding of synthetic resin such as polyethylene, polypropylene. As shown in FIG. 2, the head holder 1 has a generally box-like structure which is open upwards (downwards as seen in FIG. 2), so that the ink cartridges 61 can be removably accommodated in a cartridge installation space within the box-like structure of the head holder 1.

Figure 3:
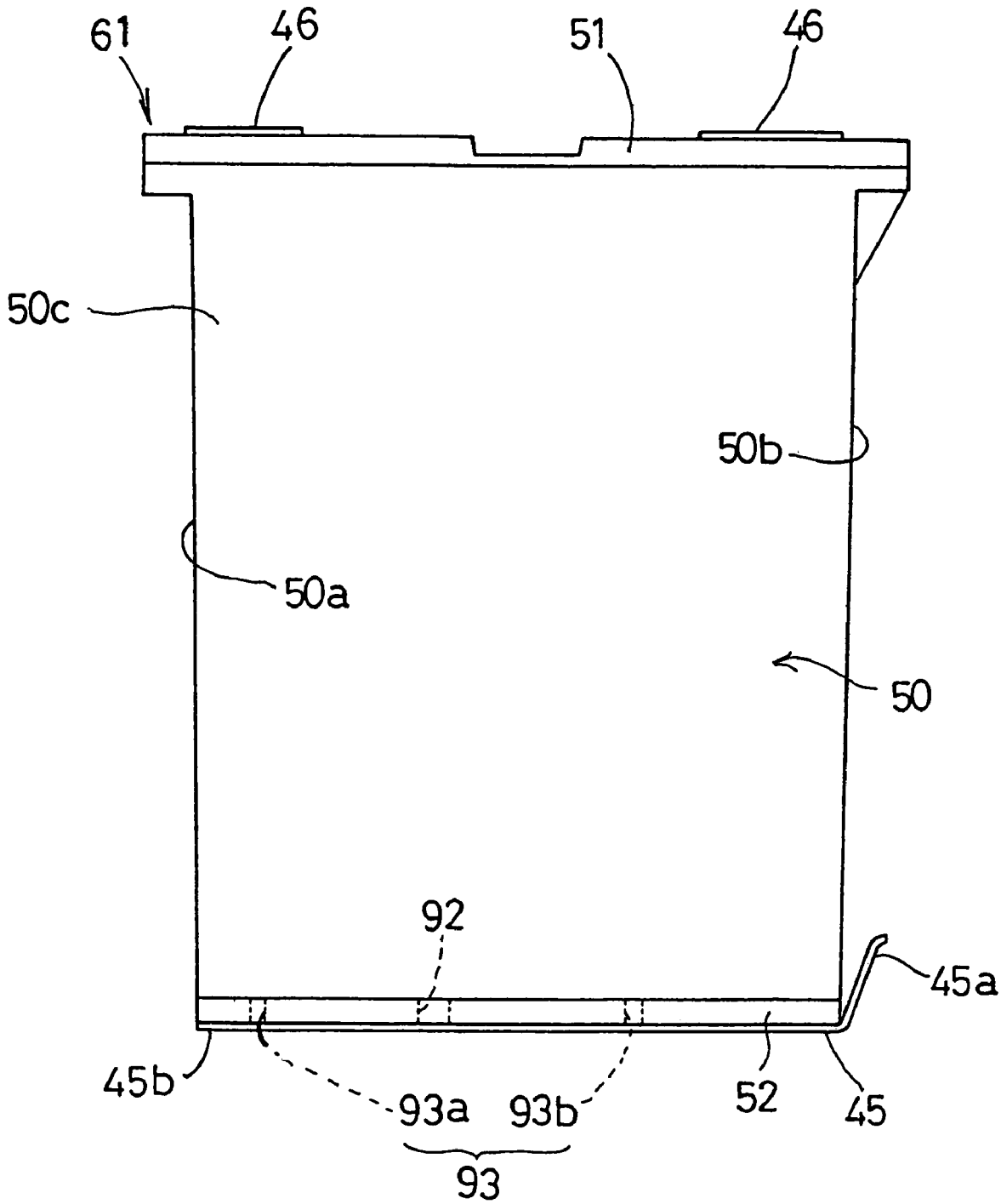
FIG. 3 is a front elevational view of an ink cartridge constructed according to a first embodiment of the invention.
Figure 4:
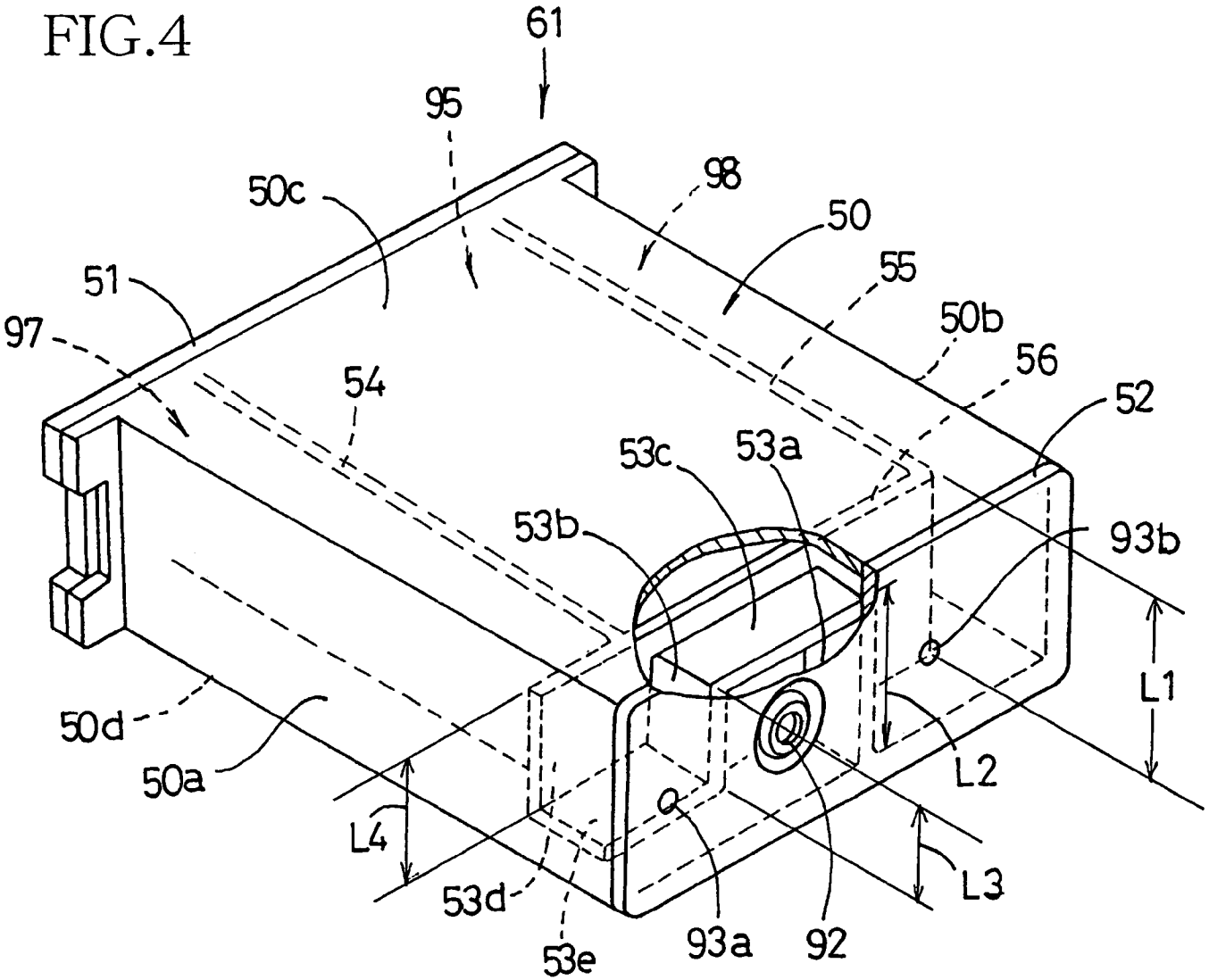
FIG. 4 is a perspective view of the ink cartridge of FIG. 3 as viewed from the bottom thereof.

By referring next to FIGS. 3 through 6, there will be described a structure of the ink cartridge 61 constructed according to the first embodiment. As shown in FIG. 3, the ink cartridge 61 includes a case 50 formed of a resin material, an upper cover member 51 disposed on an upper end of the case 50, and a lower cover member 52 disposed on a lower end of the case 50. As shown in FIGS. 3 and 4, the case 50 includes a pair of first side walls 50*a*, 50*b* which are opposed to each other and a pair of second side walls 50*c*, 50*d* which are perpendicular to the first side walls 50*a*, 50*b* and which extend between the first side walls 50*a*, 50*b* so as to connect the same. The case 50 has a generally rectangular shape in its plan view and is a hollow member having an upper and a lower open end. The upper and lower cover members 51, 52 are welded or thermally fixed to the case 50 so as to close the upper and lower open ends of the case 50, respectively. An integral body functioning as a container is formed by fixing the upper and lower cover members 51, 52 to the case 50. Further, respective outer surfaces of the first and second side walls 50*a*, 50*b*, 50*c*, 50*d* of the case 50 and respective outer surfaces of the upper and lower cover members 51, 52 constitute an outer surface of the container.

The ink cartridge 61 has an ink supply hole 92 through which the ink is supplied to the corresponding head unit 6 and a plurality of atmosphere communication holes 93 (two atmosphere communication holes in this embodiment) through which the atmosphere is introduced into the ink cartridge 61. In the present embodiment, one of the two atmosphere communication holes 93*a* is located on one of opposite sides of the ink supply hole 92 while the other atmosphere communication hole 93*b* is located on the other of the opposite sides of the ink supply hole 92. Described in detail, the lower cover member 52 which constitutes one side wall of the container has a generally rectangular shape in its plan view, and the ink supply hole 92 is formed through the thickness of the side wall (the lower cover member 52) at a generally middle portion thereof as seen in the longitudinal direction of the same 52. As described above, the two atmosphere communication holes 93*a*, 93*b* are formed through the thickness of the side wall (the lower cover member 52) such that one of the two atmosphere communication holes 93*a* is located on one of the opposite sides of the ink supply hole 92 while the other communication hole 93*b* is located on the other of the opposite sides of the ink supply hole 92 as seen in the longitudinal direction, so that the ink supply hole 92 is interposed between or sandwiched by the two atmosphere communication holes 93*a*, 93*b*. In other words, the ink supply hole 92 and the two atmosphere communication holes 93*a*, 93*b* are arranged in the longitudinal direction of the lower cover member 52 in the order of the atmosphere communication hole 93*a*, the ink supply hole 92, and the atmosphere communication hole 93*b* (as seen from the left to the right in FIG. 4).

As shown in FIG. 3, a strip member 45 is removably stuck to the outer surface of the lower cover member 52, by welding or thermal bonding, for instance, to seal the ink supply hole 92 and the two atmosphere communication holes 93*a*, 93*b*, such that the ink supply hole 92 is sealed by a longitudinally intermediate portion of the strip member 45 and such that one of the two atmosphere communication hole 93*a* is sealed by a portion of the strip member 45 which extends from the longitudinally intermediate portion toward one of longitudinally opposite ends thereof while the other atmosphere communication hole 93*b* is sealed by a portion of the strip member 45 which extends from the longitudinally intermediate portion toward the other of the longitudinally opposite ends. The strip member 45 is removed or peeled off from the ink cartridge 61 immediately before the ink cartridge 61 is installed on the head holder 1. Since the ink supply hole 92 is separately or independently provided from an ink filling hole 57 described below, the strip member 45 is stuck in advance to the outer surface of the lower cover member 52 to seal or close the ink supply hole 92 prior to filling of the ink into the cartridge 61. The strip member 45 is stuck to the outer surface of the lower cover member 52 such that the longitudinal direction of the strip member 45 is aligned with or corresponds to the longitudinal direction of the lower cover member 52, so that the strip member 45 extends over the two atmosphere communication holes 93*a*, 93*b* and the ink supply hole 92 located therebetween, to thereby seal those three holes 92, 93*a*, 93*b*. In the present embodiment, the strip member 45 has, at one of its longitudinally opposite ends 45*a* located on the side of the atmosphere communication hole 93*b*, a free end (non-sticking portion) which is not stuck to and spaced apart from the outer surface of the lower cover member 52 and which protrudes from a corresponding longitudinal end of the lower cover member 52. The strip member 45 may have the free end or non-sticking portion at the other longitudinally opposite end 45*b* located on the side of the atmosphere communication hole 93*a*, so as to protrude from a corresponding longitudinal end of the lower cover member 52. Alternatively, both of the longitudinal ends 45*a*, 45*b* of the strip member 45 may be formed as the free ends or non-sticking portions so as to protrude from the respective longitudinal ends of the lower cover member 52. The strip member 45 is formed of a flexible synthetic resin film, a metal foil, or a laminated material thereof, which have impermeability to the ink and the air.

Figure 5:
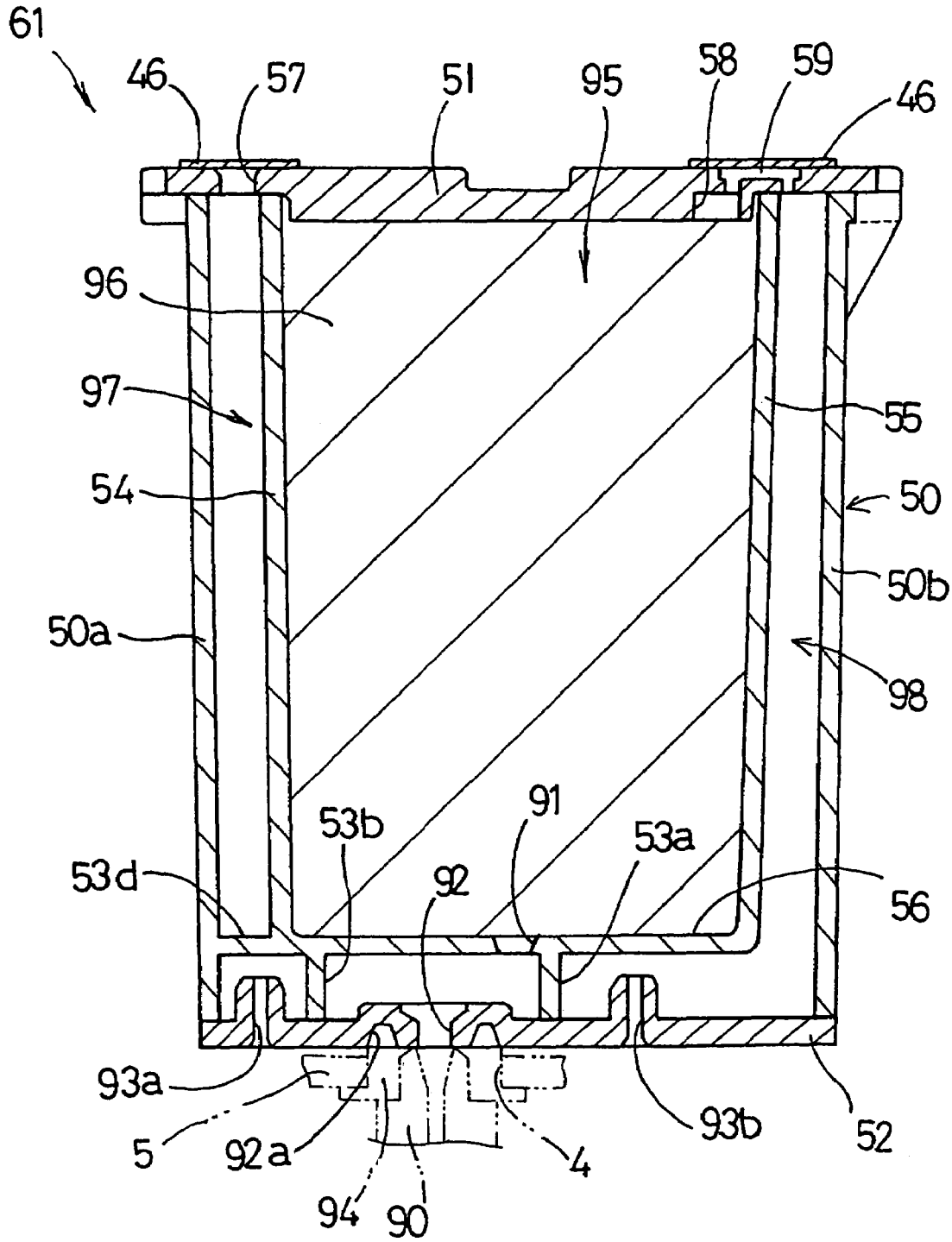
FIG. 5 is a longitudinal cross sectional view of the ink cartridge of FIG. 3.

As shown in FIG. 5, in the outer surface of the lower cover member 52, there is formed an annular groove 92*a* so as to surround the ink supply hole 92 with a suitable radial distance being kept therebetween. In the meantime, the bottom plate 5 of the head holder 1 is formed with through-holes 4 formed through the thickness thereof. A generally cylindrical packing member 94 formed of an elastic material is inserted into the corresponding through-hole 4 and fixed to the bottom plate 5 such that the axially upper and lower ends of the packing member 94 protrude from the upper and lower surfaces of the bottom plate 5, respectively. When the ink cartridge 61 is installed on the head holder 1, the axially upper end of the packing member 94 is fitted in the annular groove 92*a* of the ink cartridge 61. Further, since a sleeve member 90 (described below) which is fixed in advance to the head unit 6 is inserted into the packing member 94 from the axially lower end of the packing member 94, the ink is supplied from the ink supply hole 92 of the ink cartridge 61 to the head unit 6 via the sleeve member 90.

Next, there will be described in detail an internal structure of the ink cartridge 61. In the following description, the dimension of the ink cartridge 61 as measured in a direction perpendicular to the plane of FIG. 3 is referred to as a "depth dimension". It is noted that the upper and lower sides as seen in FIG. 3 respectively correspond to the upper and lower sides of the ink cartridge 61 as seen in the vertical direction thereof while the left and right sides as seen in FIG. 3 respectively correspond to the left and right sides of the ink cartridge 61. It is further noted that the front and rear sides as seen in the above-described depth direction respectively correspond to the front and rear sides of the ink cartridge 61.

As shown in FIGS. 4 and 5, in the case 50, there are provided a pair of inner partition walls 54, 55 which disposed inwardly of the first side walls 50*a*, 50*b* and which extend in generally parallel with the same 50*a*, 50*b* which are generally parallel with each other, and an inner bottom partition wall 56 which connects the lower ends of the partition walls 54, 55. The partition walls 54, 55 and the bottom partition wall 56 extend between the second side walls 50*c*, 50*d* so as to connect the same 50*c*, 50*d*.

Further, a plurality of partition plates or pieces are provided in the case 50 as described below in detail, and the upper cover member 51 and the lower cover member 52 are fixed, by welding or thermal bonding, to the upper and lower ends of the case 50, respectively, as described above, so that the inside space of the ink cartridge 61 is divided into three portions, i.e., a first chamber 95, a second chamber 97, and an atmosphere communication passage 98.

The first chamber 95 is a space defined by the two partition walls 54, 55, the bottom partition wall 56, the second side walls 50*c*, 50*d*, and the upper cover member 51. Within the first chamber 95, there is accommodated a porous material 96 such as polyurethane foam in which the ink is absorbed.

The second chamber 97 extends in the vertical direction of the ink cartridge 61 (in a direction from the left upper side to the right lower side as seen in FIG. 4) along the partition wall 54, and its lower end portion is bent along the lower surface of the bottom partition wall 56 (the front surface as seen in FIG. 4). Namely, the second chamber 97 has a generally "L" shape as seen from the front side of the ink cartridge 61. The second chamber 97 communicates at its lower end portion with the ink supply hole 92 formed through the lower cover member 52.

The communication passage 98 extends in the vertical direction of the ink cartridge 61 (in the direction from the left upper side to the right lower side as seen in FIG. 4) along the partition wall 55, and its lower end portion is bend along the lower surface of the bottom partition wall 56 (the front surface as seen in FIG. 4). Namely, the atmosphere communication passage 98 has a generally "L" shape as seen from the front side of the ink cartridge 61. The atmosphere communication passage 98 communicates at its lower end portion with the two atmosphere communication holes 93*a*, 93*b*.

As described above, since the two atmosphere communication holes 93*a*, 93*b* are formed in the lower cover member 52 such that one of the holes 93*a* is located on one of the opposite sides of the ink supply hole 92 while the other hole 93*b* is located on the other of the opposite sides of the ink supply hole 92, the end space of the ink cartridge 61 located between the bottom partition wall 56 and the lower cover member 52, i.e., the end space of the ink cartridge 61 located below the lower surface of the bottom partition wall 56 (the front surface as seen in FIG. 4) are divided into plurality of portions by the plurality of partition plates as described below in detail, for permitting the two atmosphere communication holes 93*a*, 93*b* to communicate with the atmosphere communication passage 98 while separating the two atmosphere communication holes 93*a*, 93*b* from the second chamber 97.

Described more specifically, partition plates 53*a*, 53*b* are provided in the above-described end space of the ink cartridge 61 so as to perpendicularly protrude from the lower surface of the bottom partition wall 56 (the front surface as seen in FIG. 4) toward the lower cover member 52 and so as to extend substantially in parallel with the first side walls 50*a*, 50*b*. The depth dimension L2 of the partition plate 53*a* (the vertical dimension as seen in FIG. 4) is smaller than the depth dimension L1 of the bottom partition wall 56 (the vertical dimension as seen in FIG. 4), that is, L2<L1. The front end of the partition plate 53*a* (the upper end as seen in FIG. 4) is spaced apart from the second side wall 50*c* while the rear end of the partition plate 53*a* (the lower end as seen in FIG. 4) is connected to the second side wall 50*d*. The depth dimension L3 of the partition plate 53*b* (the vertical dimension as seen in FIG. 4) is smaller than the depth dimension L2 of the partition plate 53*a*, that is, L3<L2. The front and rear ends of the partition plate 53*b* (the upper and lower ends as seen in FIG. 4) are spaced apart from the second side walls 50*c*, 50*d*, respectively without being connected to the same 50*c*, 50*d*. The partition plates 53*a*, 53*b* are connected to each other by a partition plate 53*c* which extends substantially in parallel with the second side wall 50*c*, such that the respective front ends of the partition plates 53*a*, 53*b* (the respective upper ends as seen in FIG. 4) are connected to respective longitudinally opposite ends of the partition plate 53*c* (the left and right ends as seen in FIG. 4).

Further, a partition plate 53*d* extends from the lower end of the partition wall 54 (the front end as seen in FIG. 4) such that the partition plate 53*d* is connected to the first side wall 50*a* and such that the partition plate 53*d* is parallel with the lower cover member 52. The partition plate 53*d* is connected to the first side wall 50*a*. The depth dimension L4 of the partition plate 53*d* (the vertical dimension as seen in FIG. 4) is smaller than the depth dimension L1 of the bottom partition wall 56, that is, L4<L1. The front end of the partition plate 53*d* (the upper end as seen in FIG. 4) is connected to the second side wall 50*c* while the rear end thereof (the lower end as seen in FIG. 4) is spaced apart from the second side wall 50*d*. A partition plate 53*e* extends perpendicularly from the rear end of the partition plate 53*d* (the lower end as seen in FIG. 4) so as to be connected to the lower cover member 52. The right end of the partition plate 53*e* as seen in FIG. 4 is connected to the rear end of the partition plate 53*b* (the lower end as seen in FIG. 4) while the left end thereof as seen in FIG. 4 is connected to the first side wall 50*a*.

Figure 6:
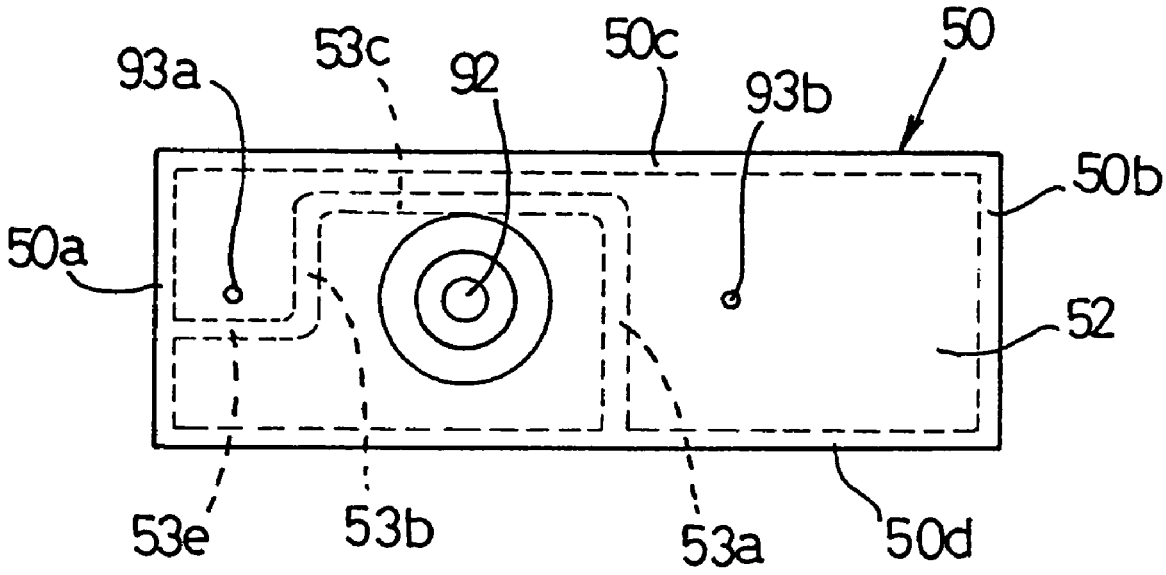
FIG. 6 is a bottom plan view of the ink cartridge of FIG. 3.

As shown in FIG. 6, the ink supply hole 92 formed through the lower cover member 52 is located so as to communicate with a first portion of the above-indicated end space of the ink cartridge 61 between the bottom partition wall 56 and the lower cover member 52, which first portion is defined by the partition plates 53*a*, 53*b*, 53*c*, 53*e*, the first side wall 50*a*, and the second side wall 50*d*. The atmosphere communication hole 93*a* is located so as to communicate with a second portion of the above-indicated end space of the ink cartridge 61 which is defined by the partition plates 53*b*, 53*d*, 53*e*, the first side wall 50*a*, and the second side wall 50*c*, while the atmosphere communication hole 93*b* is located so as to communicate with a third portion of the end space of the ink cartridge 61 which is defined by the partition plate 53*a*, the first side wall 50*b*, the second side wall 50*c*, and the second side wall 50*d*. As shown in FIG. 6, the second portion in which the atmosphere communication hole 93*a* is located and the third portion in which the atmosphere communication hole 93*b* is located are connected to or held in communication with each other by a spacing defined by and between the partition plate 53*c* and a part of the second side wall 50*c*. According to this arrangement, the ink supply hole 92 communicates with one of opposite ends (the lower end) of the second chamber 97 while the two atmosphere communication holes 93*a*, 93*b* communicate with the atmosphere communication passage 98. In the arrangement described above, a portion of the atmosphere connection passage 98 which connects the two atmosphere communication holes 93*a*, 93*b* to each other is located inwardly of the lower cover member 52 so as to detour the ink supply hole 92.

The bottom partition wall 56 is formed with a communication hole 91 for fluid communication between the first chamber 95 and the second chamber 97, as shown in FIG. 5. The ink is accommodated in the first chamber 95 which functions as an ink accommodating chamber. The volume of the first chamber 95 is sufficiently larger than that of the second chamber 97. The second chamber 97 functions as a passage through which the ink that is introduced from the ink filling hole 57 (described below) flows and also as a relay chamber when the ink is supplied from the first chamber 95 to the head unit 6.

As shown in FIG. 5, the ink filling hole 57 is formed through the upper cover member 51 at a position thereof corresponding to the upper end of the second chamber 97. Further, a pressure reduction hole 58 is formed through the upper cover member 51 at a position thereof corresponding to the upper end of the first chamber 95. The first chamber 95 and the atmosphere communication passage 98 communicate with each other by a connection passage 59 which is formed through the upper cover member 51 such that the connection passage 59 is across the upper end of the partition wall 55. The connection passage 59 has an inverted "U" shape in cross section, and communicates at one end thereof with the first chamber 95 via the pressure reduction hole 58 and at the other end with the atmosphere communication passage 98. Accordingly, in this arrangement, the atmosphere communication passage 98 is connected, via the connection passage 59, to one of opposite ends of the first chamber 95 which is located to be opposed to the other end thereof that communicates with the ink supply hole 92. Seal members 46, 46 are stuck, by welding or thermal bonding, to the outer surface of the upper cover member 51 after the ink has been filled in the ink accommodating chamber, so as to seal the ink filling hole 57 and the pressure reduction hole 58, respectively.

Next, there will be described the head unit 6 by referring to FIG. 7. The head unit 6 includes a stacked-type cavity unit 10 formed of a plurality of metal plates which are stacked on one another, a sheet-stacked type piezoelectric actuator 20 stacked on and bonded to the cavity unit 10, and a flexible flat cable 40 superposed on and bonded to the upper surface of the piezoelectric actuator 20 for electrically connecting the piezoelectric actuator 20 to an external device.

Figure 7:
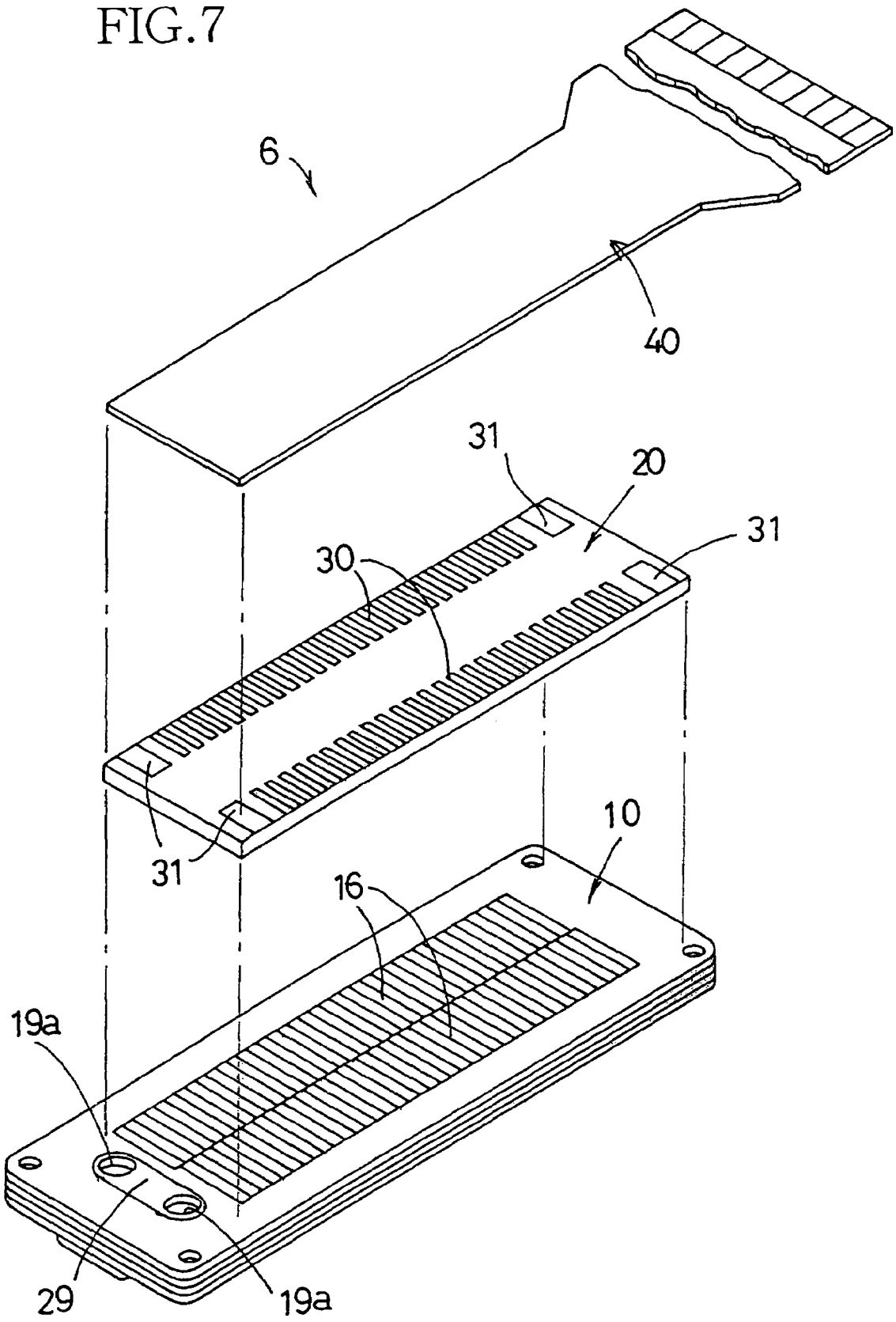
FIG. 7 is a perspective view showing components of the head unit of FIG. 1.

On the back surface of the head unit 6 (the upper surface as seen in FIG. 7), two ink supply holes 19*a*, 19*a* provided on the uppermost layer of the cavity unit 10 are exposed. A filter 29 is fixed by an adhesive agent to the uppermost layer so as to cover the ink supply holes 19*a*, 19*a* for removing foreign matter included in the ink supplied from the ink cartridge 61. To each of the ink supply holes 19*a*, 19*a*, the sleeve member 90 is fixedly bonded by an epoxy resin, for instance, via the filter 29, so as to extend therefrom. As explained above, when the head unit 6 is fixed to the head holder 1, the sleeve member 90 is inserted into the internal passage of the packing member 94 fitted within the through-hole 4 formed in the bottom plate 5 of the head holder 1, as shown in FIG. 5.

The piezoelectric actuator 20 includes a plurality of piezoelectric sheets which are stacked on each other. As disclosed in U.S. Pat. No. 5,402,159 corresponding to JP-A-4-341851, for instance, the lowermost piezoelectric sheet and odd-numbered sheets as counted from the lowermost sheet in the upward direction have strip-like individual electrodes (not shown) formed on the upper surface (one of opposite major surfaces) of each piezoelectric sheet such that the individual electrodes correspond to respective pressure chambers 16 of the cavity unit 10. Each of the even-numbered piezoelectric sheets as counted from the lowermost piezoelectric sheet in the upward direction has a common electrode (not shown) formed on the upper surface thereof (one of opposite major surfaces) such that the common electrode is common to the plurality of pressure chambers 16. As shown in FIG. 7, on the upper surface of the uppermost sheet of the piezoelectric actuator 20, there are provided surface electrodes 30 which are formed along opposite long side edges of the sheet and which are electrically connected to the respective individual electrodes, and surface electrodes 31 which are electrically connected to the common electrodes.

The thus formed sheet-stacked type piezoelectric actuator 20 is stacked on and fixed to the cavity unit 10 such that the individual electrodes of the piezoelectric actuator 20 are aligned with or correspond to the respective pressure chambers 16 of the cavity unit 10. The flexible flat cable 40 is superposed on the upper surface of the piezoelectric actuator 20, so that various wiring patterns (not shown) of the flexible flat cable 40 are electrically connected to the surface electrodes 30, 31.

The ink cartridge 61 constructed as described above is produced in the following manner, for instance. As shown in FIG. 5, the upper and lower cover members 51, 52 are fixed to the case 50 by welding or thermal bonding in a state in which the porous material 96 is accommodated in the first chamber 95 of the case 50. Upon fixing of the cover members 51, 52 to the case 50, the upper cover member 51 is welded to not only the first and second side walls 50*a*, 50*b*, 50*c*, 50*d*, but also the upper ends of the partition walls 54, 55 (the rear ends remote from the bottom partition wall 56, as seen in FIG. 4), while the lower cover member 52 is welded to not only the first and second side walls 50*a*, 50*b*, 50*c*, 50*d*, but also the lower ends of the partition plates 53*a*, 53*b*, 53*c*, 53*e* (the front ends as seen in FIG. 4).

The strip member 45 is welded to the outer surface of the lower cover member 52 such that the longitudinal direction of the strip member 45 is aligned with the longitudinal direction of the outer surface of the lower cover member 52, to thereby cover or close the ink supply hole 92 and the atmosphere communication holes 93*a*, 93*b*.

Subsequently, the air in the first chamber 95 is sucked from the pressure reduction hole 58 formed in the upper cover ember 51, so that the inside of the first chamber 95 and the inside of the second chamber 97 communicating with the first chamber 95 through the communication hole 91 are depressurized.

Then, the ink is introduced from the ink filling hole 57 formed in the upper cover member 51, so that the ink flows into the second chamber 97 and the porous material 96 of the first ink chamber 95 via the communication hole 91. After the first and second chambers 95, 97 are filled with the ink, the ink filling hole 57 ad the pressure reduction hole 58 are closed by the respective seal members 46. The thus produced ink cartridge 61 is inserted or accommodated in a sealing wrapper (not shown) and enclosed under the reduced pressure.

When the ink cartridge 61 is installed on the head holder 1, the strip member 45 which closes or seals the ink supply hole 92 and the atmosphere communication holes 93*a*, 93*b* is removed from the ink cartridge 61. Since the inside of the ink cartridge 61 is depressurized, there may be generated a layer of air in the vicinity of the ink supply hole 92 if the ink supply hole 92 is first exposed to the air before the atmosphere communication holes 93*a*, 93*b* are exposed and the air enters the ink supply hole 92. In this case, the ink ejection performance of the printing head is adversely influenced. In the present invention, however, the strip member 45 has, at one of its longitudinally opposite ends 45*a* nearer to the atmosphere communication hole 93*b*, the free end or non-sticking portion which protrudes from the corresponding longitudinal end of the lower cover member 52 and which is not stuck to the outer surface of the same 52, as shown in FIG. 3, so that the user is prompted to hold or pull the non-sticking free end portion to remove the strip member 45 from the ink cartridge 61. Since the ink supply hole 92 and the two atmosphere communication holes 93*a*, 93*b* are closed by the single strip member 45, when the strip member 45 is removed by holding it at the one longitudinal end 45*a* (non-sticking free end portion), the two atmosphere communication holes 93*b* and the ink supply hole 92 are exposed to the atmosphere inevitably in the order of one of the two atmosphere communication holes 93*b* nearer to the longitudinal end 45*a* of the strip member 45, the ink supply hole 92, and the other atmosphere communication hole 93*a* nearer to the other longitudinal end 45*b* of the strip member 45. Even if the user carelessly overlooks the free end of the strip member 45 and removes the strip member 45 by holding it at the other longitudinal end 45*b* nearer to the atmosphere communication hole 93*b*, the two atmosphere communication holes 93*a*, 93*b* and the ink supply hole 92 are exposed to the atmosphere inevitably in the order of the atmosphere communication hole 93*a*, the ink supply hole 92, and the atmosphere communication hole 93*b*. In other words, in the present embodiment wherein the ink supply hole 92 is interposed between or sandwiched by one and the other of the two atmosphere communication holes 93, 93*b*, either one of the two atmosphere communication holes 93*a*, 93*b* is always exposed to the atmosphere earlier than the ink supply hole 92 is exposed in either of a case where the strip member 45 is removed by holding it at the one longitudinal end 45*a* and a case where the strip member 45 is removed by holding it at the other longitudinal end 45*b*. The present arrangement prevents, with high reliability, troubles which may be caused by the exposure of the ink supply hole 92 to the atmosphere prior to the exposure of the two atmosphere communication holes 93*a*, 93*b* to the atmosphere.

After the ink cartridge 61 from which the strip member 45 has been removed is installed on the predetermined location of the head holder 1, the upper end portion of the packing member 94 fixed to the bottom plate 5 of the head holder 1 is fitted in the annular groove 92*a* provided on the lower surface of the ink cartridge 61, so that the ink supply hole 92 of the ink cartridge 61 is connected to the upper end of the inner portion of the packing member 94. Since the sleeve member 90 of the head unit 6 is, in advance, inserted in and fixed to the lower end of the inner portion of the packing member 94, the ink in the ink cartridge 61 can be supplied to the head unit 6. When all of the four ink cartridges 61 accommodating respective different four colors of ink are installed on the head holder 1, the four ink cartridges 61 are respectively connected to the four ink supply holes 19*a* of the two head units 6 via the respective sleeve members 90. Then, the purging device 67 (shown in FIG. 1) carries out an operation of sucking the ink in the ink cartridges 61 to supply the ink to the head units 6.

By applying a voltage between arbitrary one of the plurality of individual electrodes and the common electrodes of the piezoelectric actuator 20, portions of the piezoelectric sheets which correspond to the arbitrary individual electrode to which the voltage is applied undergo strain in the direction of stacking of the piezoelectric sheets owing to the piezoelectric effect, so that the volume of the pressure chamber 16 corresponding to the arbitrary individual electrode is reduced by the strain, whereby the ink in that pressure chamber 16 is ejected from the corresponding nozzle 11*a* in the form of droplet to carry out intended printing.

Upon ejection of the ink from the head unit 6, a negative pressure is generated in the direction of ejection of the ink, so that the ink is sucked from the corresponding ink cartridge 61. When the ink in the second chamber 97 flows through the ink supply hole 92 into the head unit 6, the ink absorbed in the porous material 96 of the fist chamber 95 is supplied to the second chamber 97. As the ink in the first chamber 95 is consumed, the atmosphere is introduced from the atmosphere communication holes 93*a*, 93*b* into the first chamber 95 via the atmosphere communication passage 98 and the connection passage 59. Thus, the ink is smoothly and effectively supplied to the head unit 6.

In the ink cartridge 61 constructed according to the first embodiment described above wherein the two atmosphere communication holes 93*a*, 93*b* are formed, only one atmosphere communication passage 98 is provided to connect the two atmosphere communication holes 93*a*, 93*b* to the first chamber 95 as an ink absorbing chamber. According to this arrangement, the volume of the atmosphere communication passage 98 in the ink cartridge 61 can be made small, to thereby reduce or minimize an amount of evaporation of the aqueous component in the ink and prevent deterioration of the ink in the ink cartridge 61.

Figure 8:
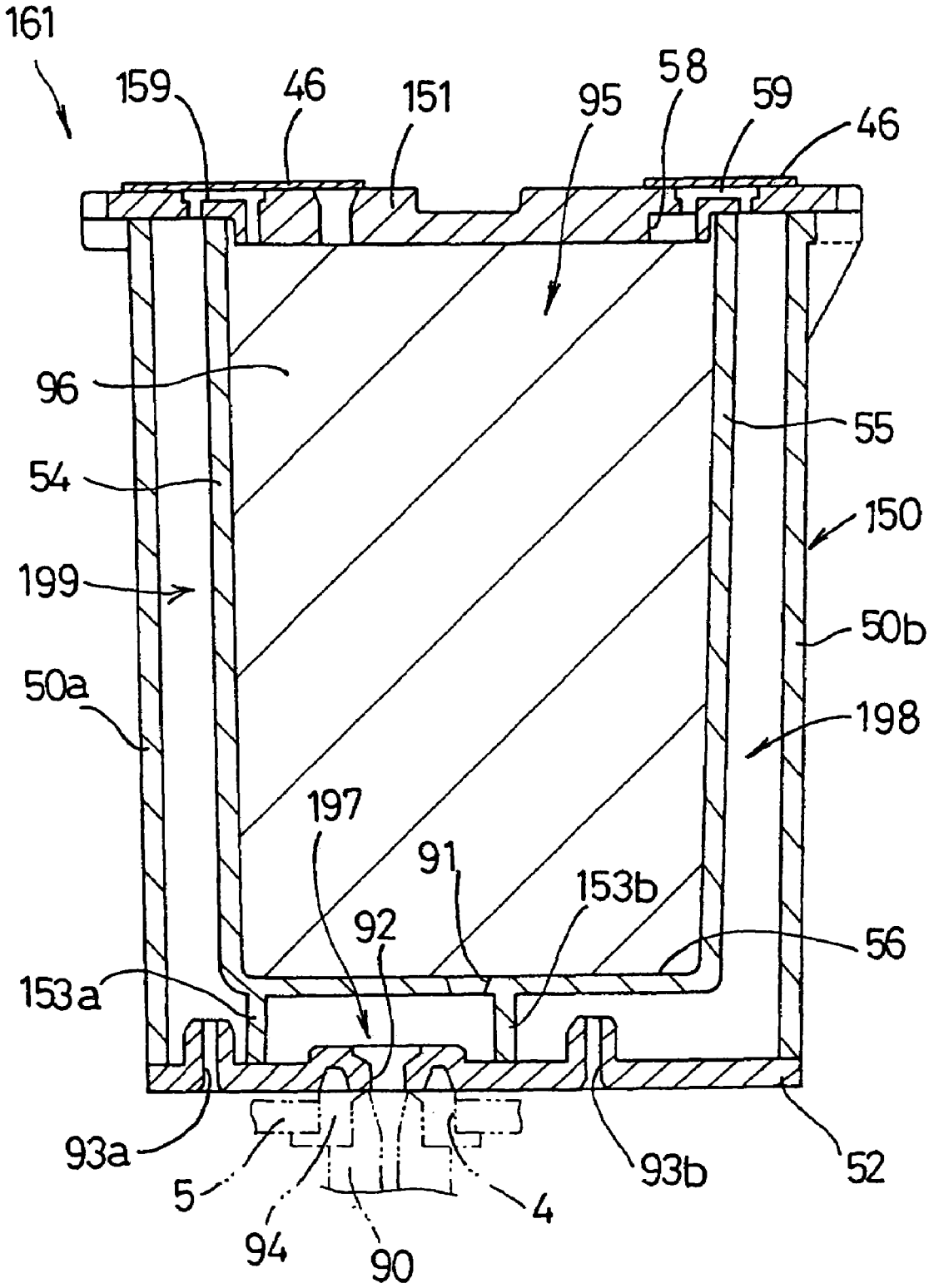
FIG. 8 is a longitudinal cross sectional view of an ink cartridge constructed according to a second embodiment of the invention.
Figure 9:
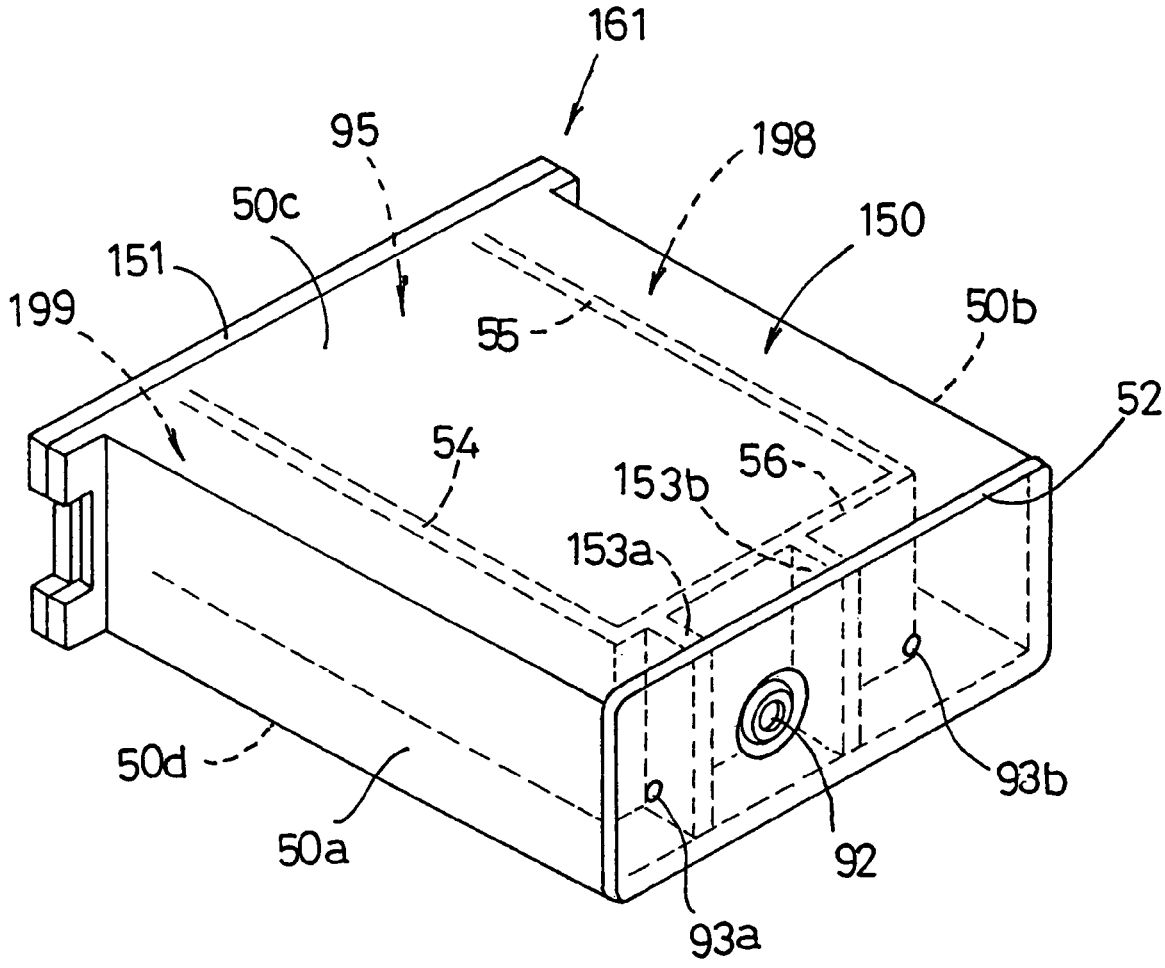
FIG. 9 is a perspective view of the ink cartridge of FIG. 8 as viewed from the bottom thereof.
Figure 10:
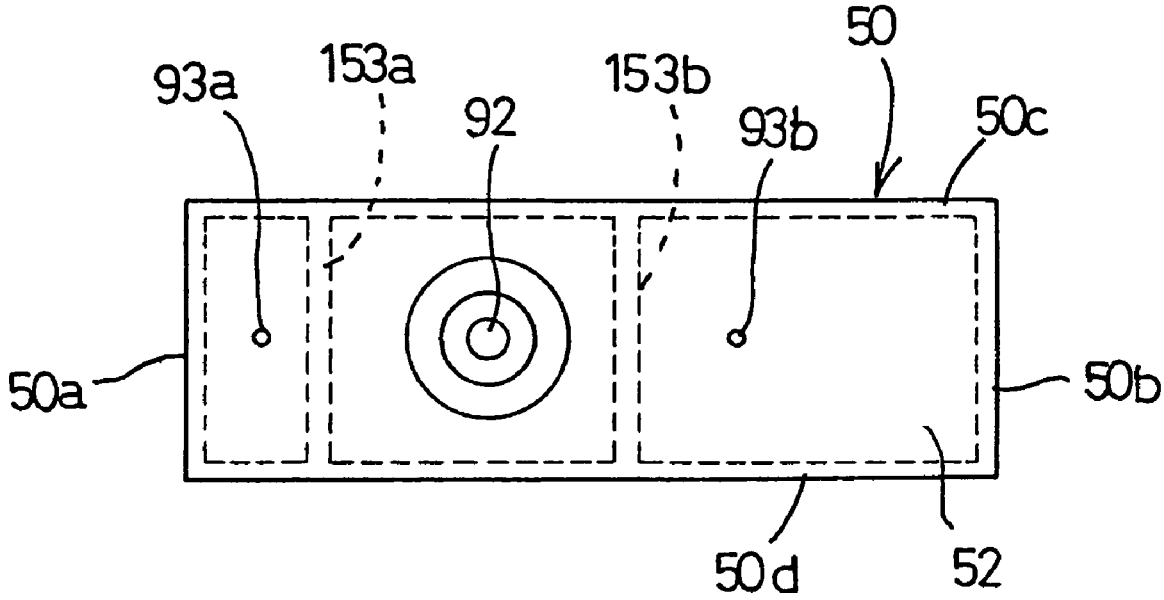
FIG. 10 is a bottom plan view of the ink cartridge of FIG. 8.

Referring next to FIGS. 8-10, there will be described an ink cartridge 161 constructed according to the second embodiment of the invention. The ink cartridge 161 of the second embodiment differs from the ink cartridge 61 of the first embodiment wherein the two atmosphere communication holes 93*a*, 93*b* are connected to one atmosphere communication passage 98, in that the atmosphere communication holes 93*a*, 93*b* are connected to respective different atmosphere communication passages, i.e., a first atmosphere communication passage 198 and a second atmosphere communication passage 199. In this second embodiment of FIGS. 8-10, the same reference numerals as used in the illustrated first embodiment are used to identify the corresponding components, and a detailed explanation of which is dispensed with.

As shown in FIGS. 8 and 9, the ink cartridge 161 includes a case 150, and an upper cover member 151 and the lower cover member 51 which are fixed to the upper and lower ends of the case 150, respectively. Within the case 150 of the ink cartridge 161, two partition plates 153*a*, 153*b* perpendicularly extend from the bottom partition wall 56 and are connected to the lower cover member 52. Owing to provision of the partition plates 153*a*, 153*b*, an end space of the ink cartridge 161 located between the bottom partition wall 56 and the lower cover member 52 is divided into three portions, i.e., a first portion communicating with the atmosphere communication hole 93*a*, a second portion communicating with the ink supply hole 92, and a third portion communicating with the atmosphere communication hole 93*b*. The third portion communicating with the atmosphere communication hole 93*b* partially constitutes the first atmosphere communication passage 198 which extends in the longitudinal direction of the ink cartridge 161 along the partition wall 55 and which is bent along the lower surface of the bottom partition wall 56. As shown in FIG. 8, the first atmosphere communication passage 198 has a generally "L" shape as seen from the front side of the ink cartridge 161. The first portion communicating with the atmosphere communication hole 93*a* partially constitutes the second atmosphere communication passage 199 which extends linearly in the longitudinal direction of the ink cartridge 161 along the partition wall 54. The second portion communicating with the ink supply hole 92 functions as a second chamber 197 which communicates with the first chamber 95 via the communication hole 91 formed in the bottom partition wall 56.

The upper cover member 151 has a connection passage 159 formed through the thickness thereof, in addition to the connection passage 59 described above with respect to the ink cartridge 61 of the illustrated first embodiment. The connection passage 159 is across the upper end of the partition wall 54 and has an inverted "U" shape in cross section. The first chamber 95 and the second atmosphere communication passage 199 communicate with each other through the connection passage 159. In the ink cartridge 161 of this second embodiment, the ink supply hole 92 functions as an ink filling hole.

In the thus constructed ink cartridge 161, the first chamber 95 and the second chamber 197 cooperate with each other to constitute the ink accommodating chamber. Upon ejection of the ink by the head unit, the ink in the second chamber 197 flows through the ink supply hole 92, and the ink absorbed in the porous member 96 of the first chamber 95 is supplied to the second chamber 197. As the ink in the first chamber 95 is consumed, the atmosphere is introduced into the first chamber 95 from the atmosphere communication hole 93*b* via the first atmosphere communication passage 198 and the connection passage 59 while the atmosphere is also introduced into the first chamber 95 from the atmosphere communication hole 93*b* via the second atmosphere communication passage 199 and the connection passage 159.

Like the ink cartridge 61 of the illustrated first embodiment, the ink cartridge 161 of this second embodiment is provided with the two atmosphere communication holes 93*a*, 93*b* such that the ink supply hole 92 is interposed between or sandwiched by one and the other of the two atmosphere communication holes 93*a*, 93*b*. As in the first embodiment, a strip member (not shown) is removably stuck to the outer surface of the lower cover member 52 to seal the ink supply hole 92 and the two atmosphere communication holes 93*a*, 93*b* such that the ink supply hole 92 is sealed by a longitudinally intermediate portion of the strip member and such that one of the two atmosphere communication holes 93*a* is sealed by a portion of the strip member which extends from the longitudinally intermediate portion toward one of longitudinally opposite ends thereof while the other atmosphere communication hole 93*b* is sealed by a portion of the strip member which extends from the longitudinally intermediate portion toward the other of the longitudinally opposite ends. According to this arrangement, when the strip member is removed from the ink cartridge 161, either one of the two atmosphere communication holes 93*a*, 93*b* is first exposed to the atmosphere before the ink supply hole 92 is exposed. Thus, like the ink cartridge 61 of the first embodiment, the ink cartridge 161 of the second embodiment effectively prevents the poor ejection of the ink due to the air entering the ink supply hole 92 as explained above.

In addition, the ink cartridge 161 has the two atmosphere communication passages 198, 199 which correspond to the atmosphere communication holes 93*a*, 93*b*, respectively, simplifying the structure of the partition plates provided in the case 150, as compared with the structure of the partition plates provided in the case 50 of the ink cartridge 61 of the first embodiment. Therefore, the present arrangement enjoys an advantage of simplified structure of molds used in molding the case 150 by using the resin material, and permits easy design and fabrication of the molds.

In the illustrated first and second embodiments, the ink supply hole 92 and the two atmosphere communication holes 93*a*, 93*b* are formed in the lower cover member 52 such that the three holes 92, 93*a*, 93*b* are arranged on a straight line. These holes 92, 93*a*, 93*b* may not be arranged on the straight line in a strict sense, as long as these holes 92, 93*a*, 93*b* can be sealed by the strip member 45 which extends in the longitudinal direction of the lower cover member 52.

By referring next to FIG. 11, there will be described an ink cartridge 261 constructed according to a third embodiment of the invention. In this third embodiment, the same reference numerals as used in the illustrated first embodiment are used to identify the corresponding components, and a detailed explanation of which is not given.

In the ink cartridge 61 of the illustrated first embodiment, the ink supply hole 92 and the two atmosphere communication holes 93*a*, 93*b* are formed in the lower cover member 52 as one of the side walls of the ink cartridge 61. In the ink cartridge 261 of the third embodiment, an ink supply hole 292 and two atmosphere communication holes 293*a*, 293*b* are formed in respective different side walls thereof.

Figure 11:
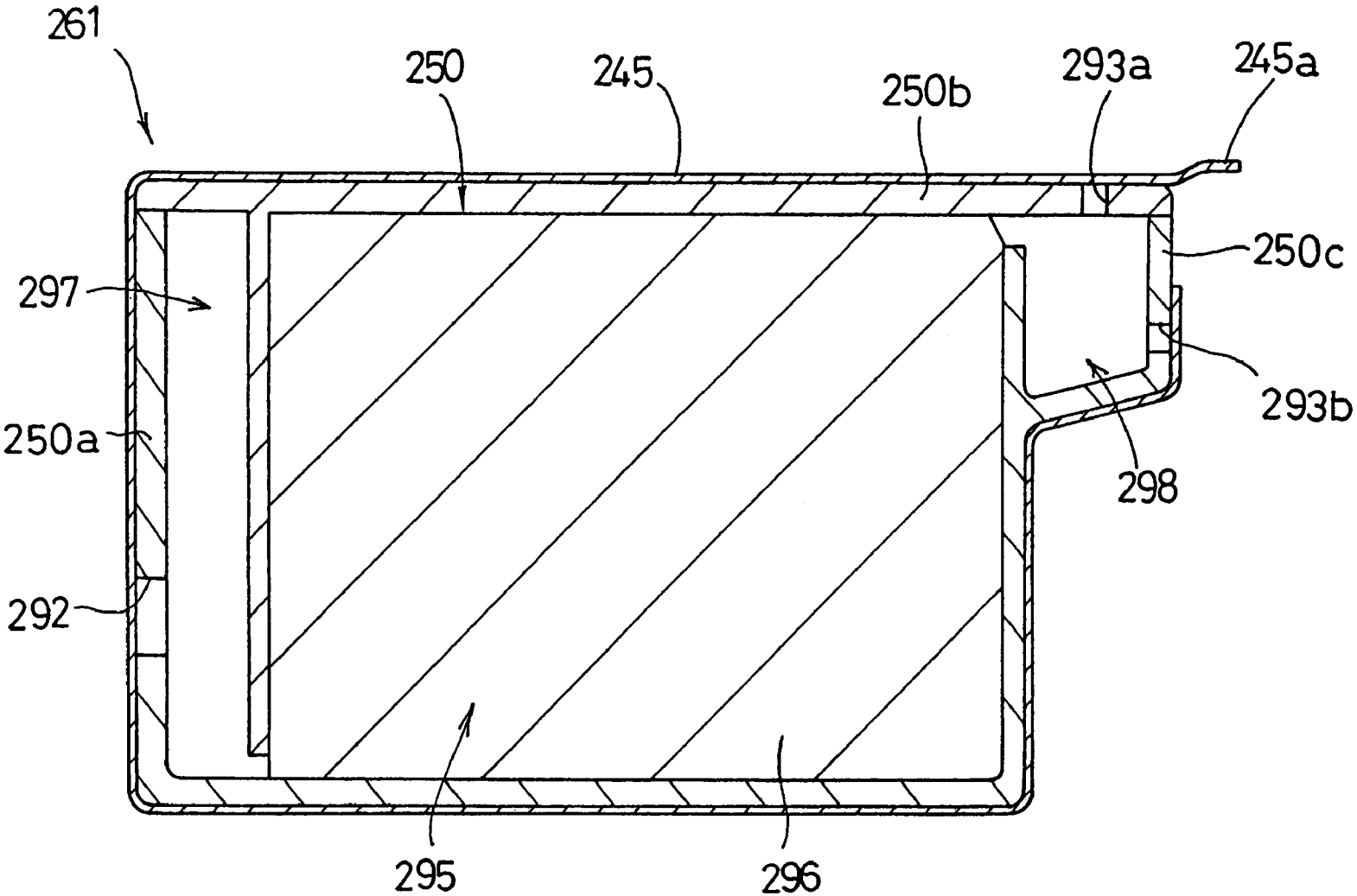
FIG. 11 is a longitudinal cross sectional view of an ink cartridge constructed according to a third embodiment of the invention.

Described more specifically, the ink cartridge 261 includes a case 250 as shown in FIG. 11. Within the case 250, there are formed a first and a second chamber 295, 297 and an atmosphere communication passage 298. The ink supply hole 292 is formed in a first side wall 250*a* of the case 250, one atmosphere communication hole 293*a* is formed in a second side wall 250*b* which is perpendicular to the first side wall 250*a*, and another atmosphere communication hole 293*b* is formed in a third side wall 250*c* which is opposed to the first side wall 250*a*. The ink supply hole 292 and the two atmosphere communication holes 293*a*, 293*b* are sealed or closed by a strip member 245 which extends over a plurality of side surfaces of the case 250, as shown in FIG. 11. Described in detail, in this ink cartridge 261, the strip member 245 is removably stuck to the side surfaces of the case 250 to seal the ink supply hole 292 and the two atmosphere communication holes 293*a*, 293*b* such that the ink supply hole 292 is sealed by a longitudinally intermediate portion of the strip member 245 and such that one of the two atmosphere communication holes 293*a* is sealed by a portion of the strip member 245 which extends from the longitudinally intermediate portion toward one of longitudinally opposite ends thereof while the other atmosphere communication hole 293*b* is sealed by a portion of the strip member 245 which extends from the longitudinally intermediate portion toward the other of the longitudinally opposite ends. The strip member 245 has, at one longitudinal end thereof 245*a*, a free end or non-sticking portion which protrudes from the case 250 and which is not stuck to any side surfaces of the case 250. Thus, the user is prompted to remove the strip member 245 by holding or taking it at the free end or non-sticking portion thereof.

In the thus constructed ink cartridge 261, when the ink is sucked into the head unit through the ink supply hole 292, the ink flows out of the second chamber 297, and the ink absorbed in a porous material 296 of the first chamber 295 is supplied to the second chamber 297. As the ink in the first chamber 295 is consumed, the atmosphere is introduced into the first chamber 295 from the two atmosphere communication holes 203*a*, 293*b* via the atmosphere communication passage 298.

Thus, the principle of the invention is applicable to the arrangement described above with respect to the third embodiment wherein the ink supply hole 292 (92) and the plurality of atmosphere communication holes 293 (93) are not formed in the same side wall of the ink cartridge 261 (61).

Each of the ink cartridges 61, 161, 261 of the illustrated first through third embodiments includes one ink supply hole 92, 292 and two atmosphere communication holes 93*a*, 93*b*, 293*a*, 293*b*. The ink cartridge may be provided with three or more atmosphere communication holes. For instance, at least three atmosphere communication holes may be arranged so as to surround one ink supply hole.

In each of the ink cartridges 61, 161 constructed according to the illustrated first and second embodiments, the ink supply hole 92 and the atmosphere communication hole 93*a*, 93*b* are formed through the thickness of the lower cover member 52 as one side wall of the container which is located on one side thereof and the strip member 45 is stuck to only the outer surface of the lower cover member 52 which is a part of the outer surface of the container. This arrangement is effective to reduce an amount of the strip member to be used to seal the ink supply hole 92 and the atmosphere communication holes 93*a*, 93*b*.

In each of the ink cartridges 61, 161 of the illustrated first and second embodiments, the ink supply hole 92 and the two atmosphere communication holes 93*a*, 93*b* are arranged in the longitudinal direction of the lower cover member 52 as one side wall of the container in the order of one of the two atmosphere communication holes 93*a*, 93*b*, the ink supply hole 92, and the other of the two atmosphere communication holes 93*a*, 93*b*. According to this arrangement, the ink supply hole 92 can be interposed between one and the other of the two atmosphere communication holes 93*a*, 93*b*. In other words, owing to provision of a minimum number of, i.e., two atmosphere communication holes, the advantages of the invention can be effectively obtained. Further, this arrangement permits the strip member 45 to be stuck, with high efficiency, to the outer surface of the lower cover member 52 as one side wall of the container located on one side of the container.

Each of the ink cartridges 61, 161, 261 constructed according to the first through third embodiments has the ink accommodating chamber consisting of the first chamber 95, 295 and the second chamber 97, 197, 297, which ink accommodating chamber communicates with the ink supply hole 92, 292. Each of the atmosphere communication holes 93*a*, 93*b*, 293*a*, 293*b* communicates with the ink accommodating chamber. In the present arrangement, when the ink in the ink accommodating chamber is supplied therefrom to the exterior of the ink cartridge through the ink supply hole, the atmosphere is introduced into the ink accommodating chamber from the atmosphere communication holes communicating with the same as the ink in the ink accommodating chamber is consumed. Thus, the ink can be smoothly and effectively supplied from the ink accommodating chamber to the exterior of the ink cartridge.

In each of the ink cartridges 61, 261 constructed according to the illustrated first and third embodiments wherein the ink accommodating chamber communicates with both of the two atmosphere communication holes 93*a*, 93*b*, 293*a*, 293*b* through one atmosphere communication passage 98, 298, the number of the communication passage communicating with the ink accommodating chamber can be made minimum, i.e., one, irrespective of the number of the atmosphere communication holes. According to this arrangement, the volume of the communication passage can be made small, to thereby prevent or reduce evaporation of the aqueous component included in the ink within the passage.

In each of the ink cartridges 61, 161, 261 constructed according to the illustrated first through third embodiments, the strip member 45, 245 has, at its one of longitudinally opposite ends 45*a*, 245*a*, the free end or non-sticking portion which is not stuck to the outer surface of the container and which protrudes from the end of the side wall of the container. The present arrangement assures the user of easy removal of the strip member from the ink cartridge and prompts the user to remove the strip member by holding it at one of its longitudinally opposite ends, so that the atmosphere communication hole can be first exposed to the atmosphere before the ink supply hole is exposed. The non-sticking portion may be provided at both of longitudinally opposite ends of the strip member. In this case, the strip member can be removed from the ink cartridge by holding either one of the non-sticking portions provided at the longitudinally opposite ends thereof. Where the non-sticking portion of the strip member does not protrude from the end of the side wall of the container and is in contact with the outer surface of the side wall, it is easy to remove the strip member if at least a portion of the non-sticking portion is bent or folded, for instance.

While the presently preferred embodiments of this invention have been described above, it is to be understood that the invention is not limited to the details of this illustrated embodiments, but may be embodied with various changes and improvements, which may occur to those skilled in the art, without departing from the spirit and scope of the present invention.

What is claimed is:

1. An ink cartridge comprising:

a container including an ink accommodating chamber in which ink is accommodated;

an ink supply hole which is formed in the container so as to be open in an outer surface of the container and which communicates with the ink accommodating chamber;

a plurality of atmosphere communication holes which are formed in the container so as to be open in the outer surface of the container and each of which communicates with the ink accommodating chamber; and a strip member which is removably stuck to the outer surface of the container to seal the ink supply hole and the plurality of atmosphere communication holes such that the ink supply hole is sealed by a longitudinally intermediate portion of the strip member and such that at least one of the plurality of atmosphere communication holes is sealed by a portion of the strip member which extends from the longitudinally intermediate portion toward one of longitudinally opposite ends thereof while at least one of the plurality of atmosphere communication holes is sealed by a portion of the strip member which extends from the longitudinally intermediate portion toward the other of the longitudinally opposite ends, wherein each of the plurality of atmosphere communication holes is open to an atmosphere after removal of the strip member, wherein the ink supply hole and the plurality of atmosphere communication holes are formed through a thickness of a side wall of the container which is located on one side of the container, and the strip member is stuck to an outer surface of the side wall which is a part of the outer surface of the container, and wherein the plurality of atmosphere communication holes comprise two atmosphere communication holes, the ink supply hole and the two atmosphere communication holes being arranged in a row in the order of one of the two atmosphere communication holes, the ink supply hole, and the other of the two atmosphere communication holes.

2. The ink cartridge according to claim 1, wherein the side wall of the container which is located on said one side of the container has a generally rectangular shape, the ink supply hole and the two atmosphere communication holes being arranged in a longitudinal direction of the rectangular wall, the strip member being stuck to the outer surface of the rectangular wall such that a longitudinal direction of the strip member is aligned with the longitudinal direction of the rectangular wall.

3. The ink cartridge according to claim 1, wherein the ink container includes an ink accommodating chamber which communicates with the two atmosphere communication holes via a communication passage, a portion of the communication passage which connects the two atmosphere communication holes to each other being located inwardly of the side wall so as to detour the ink supply hole.

4. The ink cartridge according to claim 1, wherein the strip member is formed of a flexible synthetic resin film or a metal foil, which have impermeability to ink and air.

5. The ink cartridge according to claim 1, further comprising at least one communication passage each of which is connected to the ink accommodating chamber and at least one of the plurality of atmosphere communication holes, so that the ink accommodating chamber and the at least one of the plurality of atmosphere communication holes communicate with each other.

6. The ink cartridge according to claim 5, wherein said at least one communication passage consists of a plurality of communication passages the number of which is equal to that of the atmosphere communication holes, the ink accommodating chamber communicating with each of the atmosphere communication holes through each of the plurality of communication passages.

7. The ink cartridge according of claim 5, wherein said at least one communication passage is one communication passage through which the ink accommodating chamber communicates with all of the plurality of atmosphere communication holes.

8. The ink cartridge according to claim 5, wherein each of said at least one communication passage is connected to one of opposite ends of the ink accommodating chamber which is located to be opposed to the other of the opposite ends which communicates with the ink supply hole.

9. The ink cartridge according to claim 1, wherein the strip member includes, at least one of the longitudinally opposite ends thereof, a non-sticking portion which is not stuck to the outer surface of the container.

10. The ink cartridge according to claim 9, wherein the non-sticking portion is provided only at one of the longitudinally opposite ends of the strip member.

11. The ink cartridge according to claim 9, wherein at least a part of the non-sticking portion is spaced apart from the outer surface of the container.

12. The ink cartridge according to claim 9, wherein at least a part of the non-sticking portion protrudes from an end of a wall of the container to which a portion of the strip member that is contiguous to the non-sticking portion is stuck.

13. The ink cartridge according to claim 1, wherein the container includes a pair of first side walls, a pair of second side walls, an upper cover member, and a lower cover member, an inside space of the container being divided into an ink accommodating chamber and at least one communication passage, the lower cover member being formed with the ink supply hole which communicates with the ink accommodating chamber and the plurality of atmosphere communication holes which communicate with the ink accommodating chamber via the at least one communication passage.

14. The ink cartridge according to claim 13, wherein the ink supply hole and the plurality of atmosphere communication holes are formed in the lower cover member in a row such that the ink supply hole is interposed between any one of the plurality of atmosphere communication holes and another any one of the plurality of atmosphere communication holes.

15. The ink cartridge according to claim 13, wherein the container further includes a pair of inner partition walls which respectively extend generally parallel with the first side walls that are generally parallel with each other and an inner bottom partition wall which extend generally parallel with the lower cover member, the ink accommodating chamber being defined by the pair of second side walls, the pair of inner partition walls, the upper cover member, and the inner bottom partition wall, the container further including at least one partition plate disposed in a space between the inner bottom partition wall and the lower cover member so as to divide the space into a first portion which communicates with the ink supply hole and the ink accommodating chamber, and at least one second portion which partially constitutes the at least one communication passage.

16. The ink cartridge according to claims 15, wherein the first portion and the ink accommodating chamber communicate with each other via a hole formed in the inner bottom partition wall.

17. The ink cartridge according to claim 15, wherein the at least one communication passage communicates with the ink accommodating chamber via at least one connection passage formed in the upper cover member.

* * * * *